United States Patent [19]

Falconer

[11] Patent Number: 4,852,399

[45] Date of Patent: Aug. 1, 1989

[54] METHOD FOR DETERMINING DRILLING CONDITIONS WHILE DRILLING

[75] Inventor: Ian G. Falconer, The Meadows, Tex.

[73] Assignee: Anadrill, Inc., Sugar Land, Tex.

[21] Appl. No.: 218,730

[22] Filed: Jul. 13, 1988

[51] Int. Cl.[4] ..... E21B 49/00

[52] U.S. Cl. ..... 73/151.5; 175/39; 175/50

[58] Field of Search ..... 73/151, 151.5, 152; 175/50, 39

[56] References Cited

U.S. PATENT DOCUMENTS

| | | | |
|---|---|---|---|
| Re. 21,297 | 12/1939 | Mizell | 255/1 |
| Re. 28,436 | 6/1975 | Vitter, Jr.et al. | 175/39 |
| 2,372,576 | 3/1945 | Hayward | 73/152 |
| 2,669,871 | 2/1954 | Lubinski | 73/151 |
| 3,368,400 | 2/1968 | Jorden et al. | 73/151.5 |
| 3,541,852 | 11/1970 | Brown et al. | 73/151 |
| 3,581,564 | 6/1971 | Young | 73/151 |
| 3,774,445 | 11/1973 | Rundell et al. | 73/151 |
| 3,782,190 | 1/1974 | Pittman | 73/151 |
| 3,898,880 | 8/1975 | Kelseaux et al. | 73/151.5 |
| 3,916,684 | 11/1975 | Rundell | 73/151.5 |
| 4,064,749 | 12/1977 | Pittman et al. | 73/152 |
| 4,359,898 | 11/1982 | Tanguy et al. | 73/151 |
| 4,627,276 | 12/1986 | Burgess et al. | 73/151 |
| 4,685,329 | 8/1987 | Burgess | 73/151 |
| 4,697,650 | 10/1987 | Fontenot | 73/151.5 |

*Primary Examiner*—Stewart J. Levy
*Assistant Examiner*—Kevin D. O'Shea
*Attorney, Agent, or Firm*—Stephen L. Borst

[57] ABSTRACT

Downhole torque and rate of penetration are utilized to develop indications of formations that are porous, argillaceous or tight. This information is useful as an aid in selecting drilling practices and drilling bits. The method separates bit effects from lithology effects when drilling with roller cone or PDC bits by utilizing surface and subsurface wellsite sensors to determine averaged values of real time penetration rate and downhole torque. Changes in bit torque are used to broadly classify the lithology into three categories: porous, argillaceous and tight formations while trends in bit torque and rate of penetration in shale are used to separate wear of the bit from changes in formation strength.

14 Claims, 5 Drawing Sheets

METHOD FOR DETERMINING DRILLING CONDITIONS WHILE DRILLING

BACKGROUND AND DESCRIPTION OF THE PRIOR ART

It is well known that oil field borehole evaluation may be performed by wireline conveyed instruments following the completion of the process of drilling a borehole. Such techniques have been available to the oil field industry for decades. Unfortunately, wireline investigation techniques are frequently disadvantageous due to their nature which requires that they be performed a substantial time after drilling and after the drill pipe has been removed from the borehole. Additionally, while the wireline techniques are effective in determining formation parameters, they are unable to provide insight into the borehole drilling process itself.

In response to the shortcomings of wireline investigations, techniques which perform measurements while the borehole is being drilled are receiving greater acceptance by the oil field industry as standard, and indeed on occasion, indispensable services. Many such techniques differ from the traditional wireline techniques in that the MWD techniques are able to measure drilling parameters which not only provide information on the drilling process itself but also on the properties of the geological formations being drilled. Due to the relatively recent increased use of many MWD techniques, the oil field industry is still in the process of learning from experience how to most effectively utilize the new information that is becoming available from MWD. Perhaps not surprisingly, accumulating experience is revealing some rather unexpected results that may significantly improve the knowledge and efficiency of the process of forming boreholes in the earth.

U.S. Pat. No. 4,627,276, entitled Method For Measuring Bit Wear During Drilling by Burgess and Lesso, which is assigned to the assignee of the present invention and which is hereby incorporated by reference, proposed techniques for determining an index indicative of bit efficiency from surface and downhole derived drilling parameters. It also proposed techniques for generating an index indicative of the flatness of the teeth of the drill bit. These indices have proven invaluable in assisting in the drilling of a borehole since they enable the driller to determine in real time the condition of the bit and its efficiency in "making hole".

Unfortunately, the described techniques, while encountering success in many downhole conditions, are less effective in some other downhole conditions. Specifically, the techniques described in the above mentioned patent function best in argillaceous (shaley) formations. Through additional experience gained by numerous applications of the techniques in the drilling of boreholes, the discovery has been made that it is not always evident to the driller whether the drill bit is in an argillaceous formation that is exhibiting changing properties as the bit advances through the formation or whether the bit is encountering a lithological change from the argillaceous formation to one in which the described technique is less effective, such as sandstone or limestone. A downhole MWD natural gamma ray instrument may be of assistance in distinguishing between sandstone and argillaceous lithologies. This information is not available in real time at the location of the bit however. Typically, MWD sensors are positioned in the drill string at some distance from the bit so that, while the natural gamma ray is frequently used to distinguish sands from shales, this ability only comes into effect at some time after the bit has generated the formation, which is frequently too late.

It is, therefore, clearly desirable to identify the kind of formation being drilled, as it is being drilled, in order to enable the driller to determine whether the information derived by way of the prior art indexes of bit efficiency and dimensionless tooth flat adequately describe the current drilling conditions. It has not heretofore been evident how to distinguish between changing lithologies and a formation of the same lithology that is exhibiting a change in a "hardness" property.

SUMMARY OF THE INVENTION

Additional techniques have now been discovered that address the task of distinguishing changing lithologies from a constant lithology exhibiting changing drillability properties. In the practice of the preferred embodiment of the present invention, a parameter designated "dimensionless torque" determined from downhole measurements made while drilling (MWD), is utilized to determine an indication of the drilling efficiency of the drill bit. Comparison of drilling efficiency with its running average enables the determination that the bit is drilling either an argillaceous formation or a tight or porous formation. When the formation being drilled is determined to be non-argillaceous, the last valid measurement of drilling efficiency in an argillaceous formation is utilized in further interpretation. Additionally, a parameter designated "dimensionless rate of penetration" is combined with a measure of downhole weight on bit to generate an indication of the resistance to penetration of the formation by the bit. The values of this "formation strength" parameter are then collared to a predetermined "formation strength" value in order to determine whether the bit is penetrating a porous formation or if it is experiencing either a tight formation or other cause of abnormal torque. Ambiguity is resolved by referring to the magnitude of the drilling efficiency parameter relative to the running average.

Figure 1:
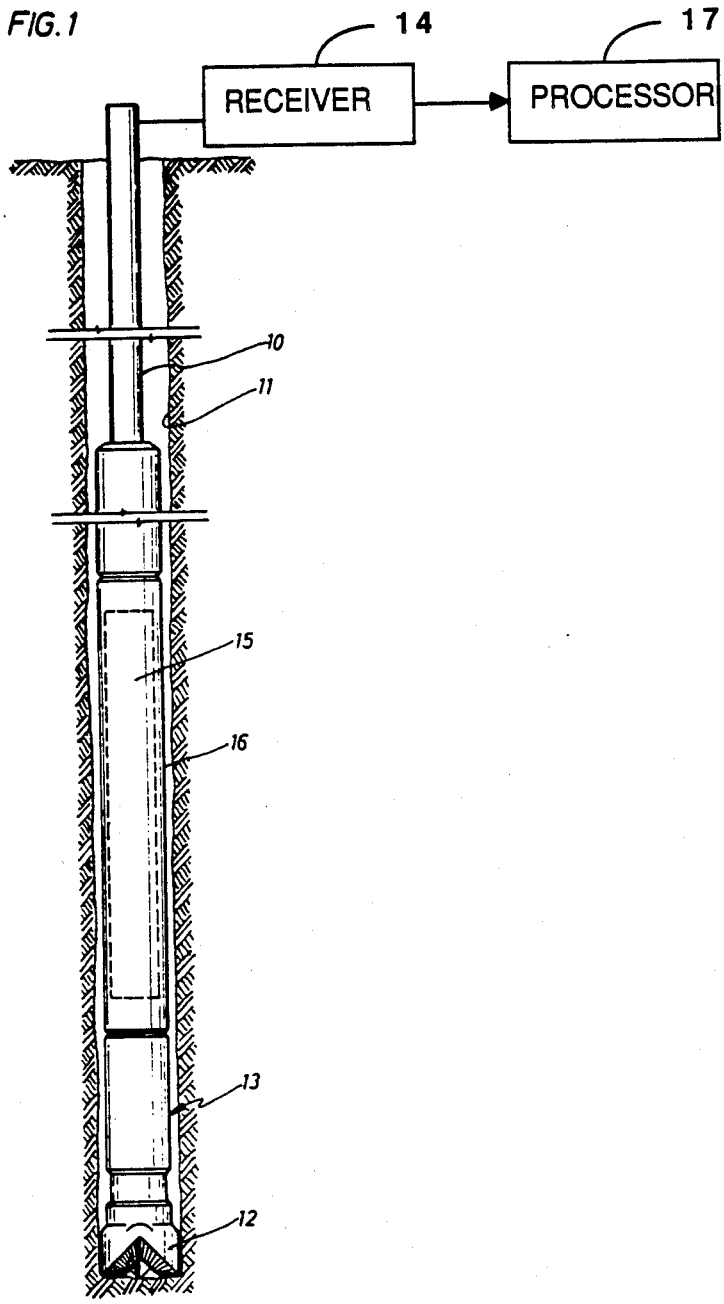
FIG. 1 is an illustration of an MWD apparatus in a drill string with a drill bit while drilling a borehole.

Referring initially to FIG. 1, there is shown a drill string 10 suspended in a borehole 11 and having a typical drill bit 12 (preferably of the insert bit type but alternatively of the PDC type) attached to its lower end. Immediately above the bit 12 is a sensor apparatus 13 for detection of downhole weight on bit (W) and downhole torque (T) constructed in accordance with the invention described in U.S. Pat. No. 4,359,898 to Tanguy et al., which is incorporated herein by reference. The output of sensor 13 is fed to a transmitter assembly 15, for example, of the type shown and described in U.S. Pat. No. 3,309,656, Godbey, which is also incorporated herein by reference. The transmitter 15 is located and attached within a special drill collar section 16 and functions to provide in the drilling fluid being circulated downwardly within the drill string 10 an acoustic signal that is modulated in accordance with sensed data. The signal is detected at the surface by a receiving system 17 and is processed by a processing means 14 to provide recordable data representative of the downhole measurements. Although an acoustic data transmission system is mentioned herein, other types of telemetry systems, of course, may be employed, provided they are capable of transmitting an intelligible signal from downhole to the surface during the drilling operation.

Figure 2:
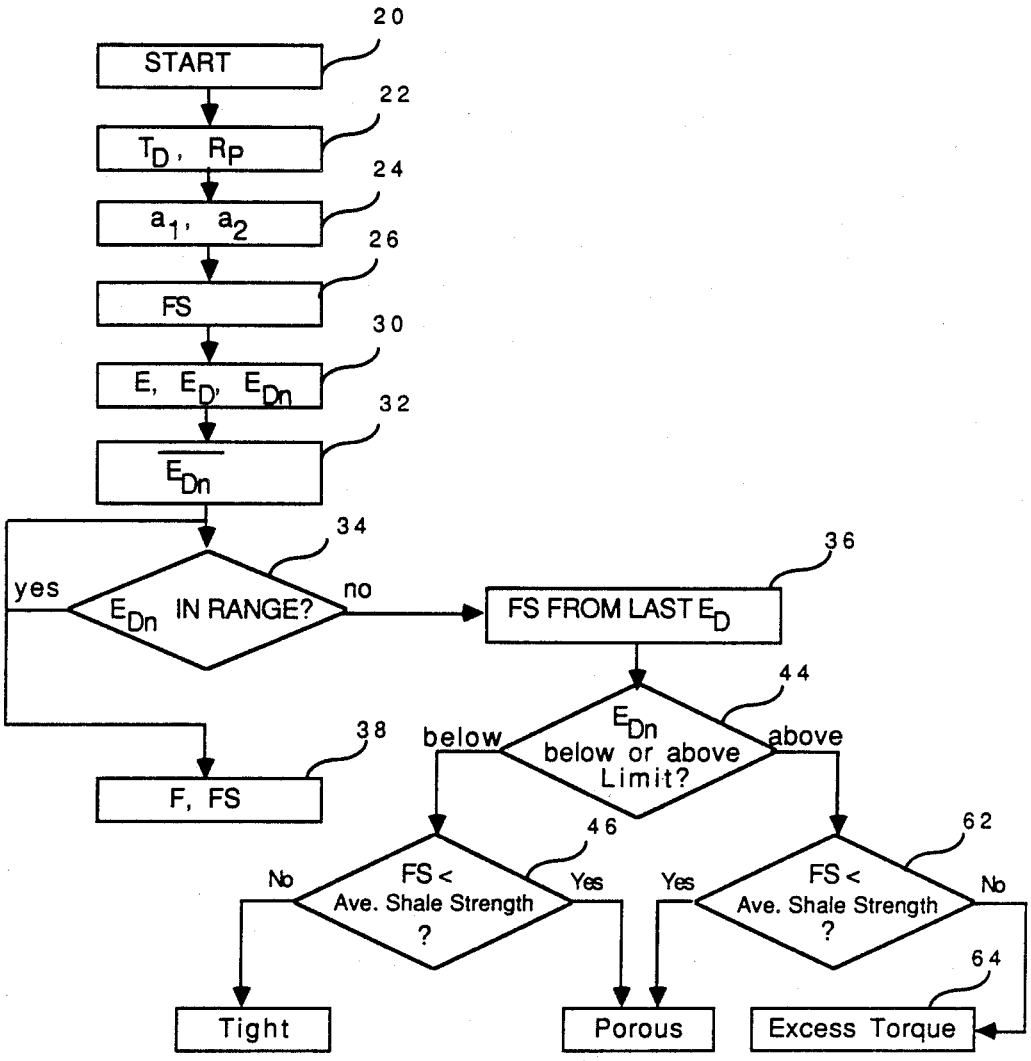
FIG. 2 is a block diagram of the interpretation functions performed on the drilling parameters generated from the apparatus of FIG. 1.

Reference is now made to FIG. 2 for a detailed representation of a preferred embodiment of the present invention. FIG. 2 illustrates the processing functions performed within the surface processing means 17. The downhole weight on bit (W) and downhole torque (T) signals derived from real time, in situ measurements made by MWD tool sensors 13 are delivered to the processor 17. Also provided to processor 17 are surface determined values of rotary speed (RPM), Bit Size (D), and Rate of Penetration (R). In a broad sense, processor 17 responss to the rate of penetration and downhole torque inputs to detect the occurrence of changing lithology as distinguished from changes in the "toughness" of the formation rock as well as other effects such as bit wear, excess torque due to stabilizer gouging and cone locking.

While the present invention may be practiced by programming processor 17 to respond merely to W, R and T, it has been found that improved results are obtained when R and T are converted into the normalize quantities "Dimensionless Rate of Penetration" (RD) and "Dimensionless Torque" ($T_D$) respectively. This is performed in processor 17 as illustrated in FIG. 2 at 22, after the variables have first been initialized at 20, according to the following relationships:

$$R_D = 0.2R/RPM*D \quad (1)$$

$$T_D = 12T/W*D \quad (2)$$

where R is the rate of penetration of the drill bit in feet per hour, RPM is the rate of rotation of the bit measured in revolutions per minute, D is the diameter of the bit in inches, T is the downhole torque experienced by the bit in thousands of foot pounds, W is the downhole value of weight placed on the bit in klbs, and FORS is the "Formation Strength" according to equation:

$$FORS = 40a_1W*RPM/R*D \quad (3)$$

which is calculated at 26 in FIG. 2.

Returning to 24 of FIG. 2, once $T_D$ and $R_D$ have been obtained, they may be combined in any suitable manner in processor 17 to obtain the coefficients ($a_1$, $a_2$) of a drilling equation, as is taught in U.S. Pat. No. 4,627,276, that expresses bit drilling efficiency $E_D$ as a function of dimensionless torque and dimensionless rate of penetration. Briefly, data points representative of $T_D$ and the root to the nth power (usually taken as the square root) of $R_D$ obtained at the beginning of a bit run when the bit is unworn, when plotted against each other define a straight line curve having a y axis intercept at $a_1$ and having a slope of $a_2$. Values of $a_1$ and $a_2$ are determined by the processor and are subsequently used in the analysis, for example in equation 3 above.

Having determined dimensionless torque, dimensionless rate of penetration, $a_1$, and $a_2$, the quantities known as the Dimensionless Efficiency (E), the Dimensionless Efficiency corrected for friction ($E_D$), and the Dimensionless Efficiency Normalized for changes in weight on bit ($E_{Dn}$)may now be determined at 30 according to the following equations:

$$E = (T_D - a_2\sqrt{R_D})/a_1 \quad (4)$$

$$E_D = [E - \mu \tan\theta]/[1 - \mu\tan\theta] \quad (5)$$

$$E_{Dn} = [1 - (1 - E_D)W]/W_{norm} \quad (6)$$

where u is the coefficient of friction between the rock being drilled and the teeth of the drill bit, $\theta$ is the angle of attack of the teeth of the bit (tooth semiangle or roller cone bits or the rake angle for PDC bits), and $W_{norm}$ is the normal or recommended weight for the bit being used. As will be appreciated from the above relationships, E, $E_D$, and $E_{Dn}$ are primarily dependent on the downhole torque T.

Experience in the field with the parameter $E_{Dn}$ has led to the discovery that when in an argillaceous formation, $E_{Dn}$, on average, varies slowly under normal drilling conditions as the bit wears. In non-argillaceous formations, $E_{Dn}$ exhibits more erratic behavior. This observation enables one to monitor the behavior of $E_{Dn}$ as an indication of whether the bit is drilling an argillaceous or a non-argillaceous formation. In general, this is done by generating a reference value indicative of argillaceous formation drilling. Preferably the reference value is one which is primarily dependent on torque (T). such as $E_{Dn}$. One may then compare a current value of $E_{Dn}$ to the reference value in order to determine if the bit is currently drilling argillaceous formations. For example, the reference value may be the running average of the previous five values of $E_{Dn}$ derived while the bit was drilling argillaceous formations. When drilling has just been initiated so that five values of $E_{Dn}$ are not available, the reference value is assumed to be one for a new bit and some other representative value less than one for a worn bit.

Thus, at 32 a running average of values of $E_{Dn}$ derived from argillaceous formations is obtained. The running average functions as the above mentioned predetermined reference value dependent primarily on T. A window with high and low cutoffs or limits is formed around the running average and at 34 the current value of $E_{Dn}$ is compared to the last value of the running average. Where it is observed that $E_{Dn}$ varies slowly, $E_{Dn}$ will remain within the window formed around the running average and it is concluded that the bit is drilling an argillaceous formation Where it is observed that $E_{Dn}$ varies rapidly relative to its running average, the current value of $E_{Dn}$ will exceed the window around the running average and it is concluded that the variation is caused by an effect other than bit wear, such as changes in formation strength produced by a different, non-argillaceous lithology.

Determination of argillaceous versus non-argillaceous formations is of significance not only for the drilling process but also for subsequent interpretation, since it has been discovered that the erratic behavior of $E_{Dn}$ in non-argillaceous formations does not permit reliable determinations of the effects of bit wear. Accurate values of bit wear are essential in odder to properly correct for the effects of the wear of the bit on the measured parameters such as downhole torque. It has therefore been found expedient, where it has been determined that the bit is drilling a non-argillaceous formation, to employ the last value of $E_{Dn}$ when the bit was still drilling an argillaceous formation in order that the information be meaningful.

If the comparison at 34 reveals that the current value of $E_{Dn}$ is within the window formed about the running average of $E_{Dn}$, the current value may be used in a determination at 38 of "Flat" and "Fors" (herein appearing as F and FS respectively) which may generally be thought of as the degree of wear of the bit (F) and a measure of the resistance to penetration of the formation by the bit (FS) respectively. F and FS are determined according to the following relationships:

$$F=8(1-A^{E}D_{n}) \quad (7)$$

$$FS=40a_1W^*RPM/R^*D \quad (8)$$

Where $A^{E}D_{nm}$ is the running average of $E_{Dn}$ in argillaceous formations. The coefficient 8 is utilized here to correspond to the industry practice of grading a worn bit from 1 to 8 with 1 designating a new, unworn bit and 8 designating a bit that is completely worn out.

In FIG. 2 functional block 38 is implemented to derive indications of F and FS where the value of $E_{Dn}$ falls within the high and low limits of the window placed around the running average of $E_{Dn}$. If $E_{Dn}$ falls outside of this window, it is apparent that the bit is not drilling in an argillaceous formation (shale) or that a drilling problem is developing.

In order to further understand the nature of the events causing the normalized drilling efficiency to behave erratically, a current value of FS is determined at 36 from the last valied value of $E_C$ derived while $E_{Dn}$ remained within the window around the running average of $E_{Dn}$ from the following equation:

$$FS=E_D[40a_1W^*RPM/R^*D]. \quad (9)$$

Next it is determined at 44 whether $E_{Dn}$ is above or below the the limits of the window around the running average of $E_{Dn}$. If above, the step of comparing the value of FS determined at 36 with an average shale strength is performed at 62. If FS turns out to be less than the average shale strength by forty percent, it may safely be concluded that the formation is a porous one.

On the other hand, if FS is equal to or greater than the average shale strength, it is concluded that the readings are a result of a drilling condition other than lithology such as the generation of abnormal torque between the downhole measuring transducers and the drill bit such as a locked cone or a gouging stabilizer which may be related to an undergauge bit. The magnitude of the abnormal torque may be determ ined at 64 from the following relationship:

$$XSTQ = T - W^*D(a_1E_D^* + a_2\sqrt{R_D}) \quad (10)$$

where XSTQ is the abnormal (usually excess) torque below the MWD tool, and $E_D^*$ is the last valid value of $E_D$ obtained while the bit is still in an argillaceous formation.

If the comparasion in decision element 44 shows that current values of $E_{Dn}$ are below the low limit of the window around the running average of $E_{Dn}$, it is next determined at 46 whether the current value FS is less than an average shale strength by forty percent. If so, it is concluded that the non-argillaceous formation being drilled is porous. If the comparison at 46 shows that the current value of FS is equal to or greater than the average shale strength, it is concluded that the non-argillaceous formation being drilled is one of low porosity or "tight". In either case a formation properties curve may be determined by dividing $E_{Dn}$ by the average value of $E_{Dn}$. Such a curve, appearing in FIG. 5 can be drawn with a central band within which is an indication of argillaceous formations and outside of which is an indication of porous formations in the increasing and tight formations in the decreasing directions.

Figure 3:
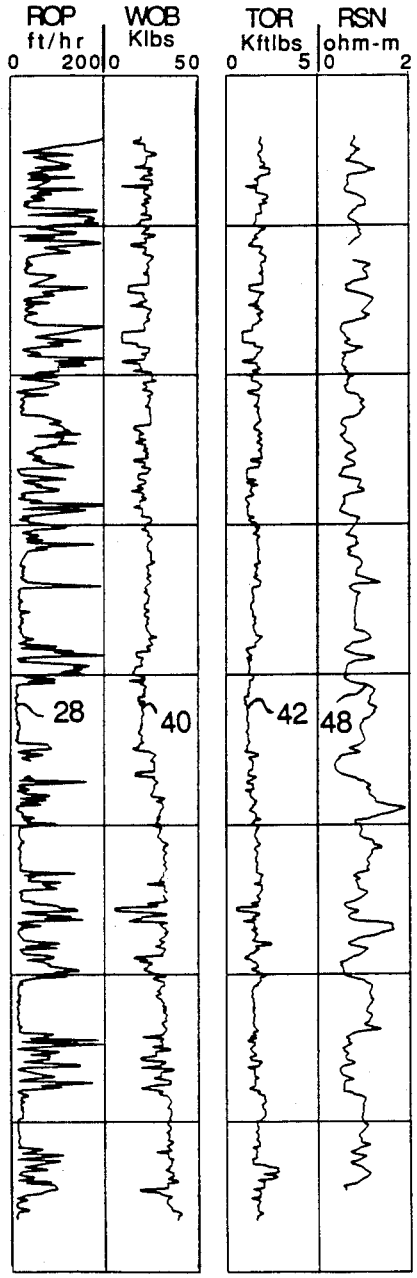
Figure 4:
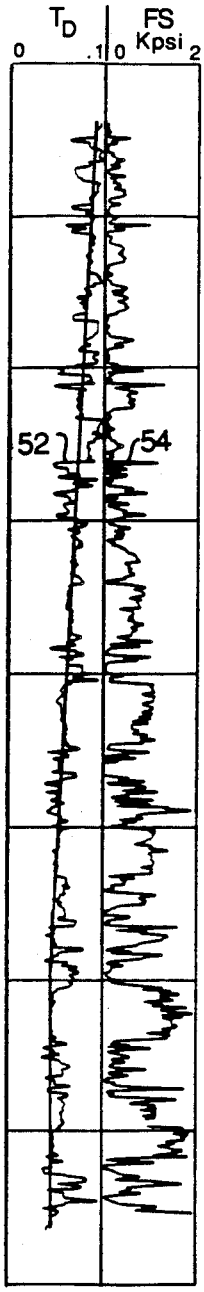
Figure 5:
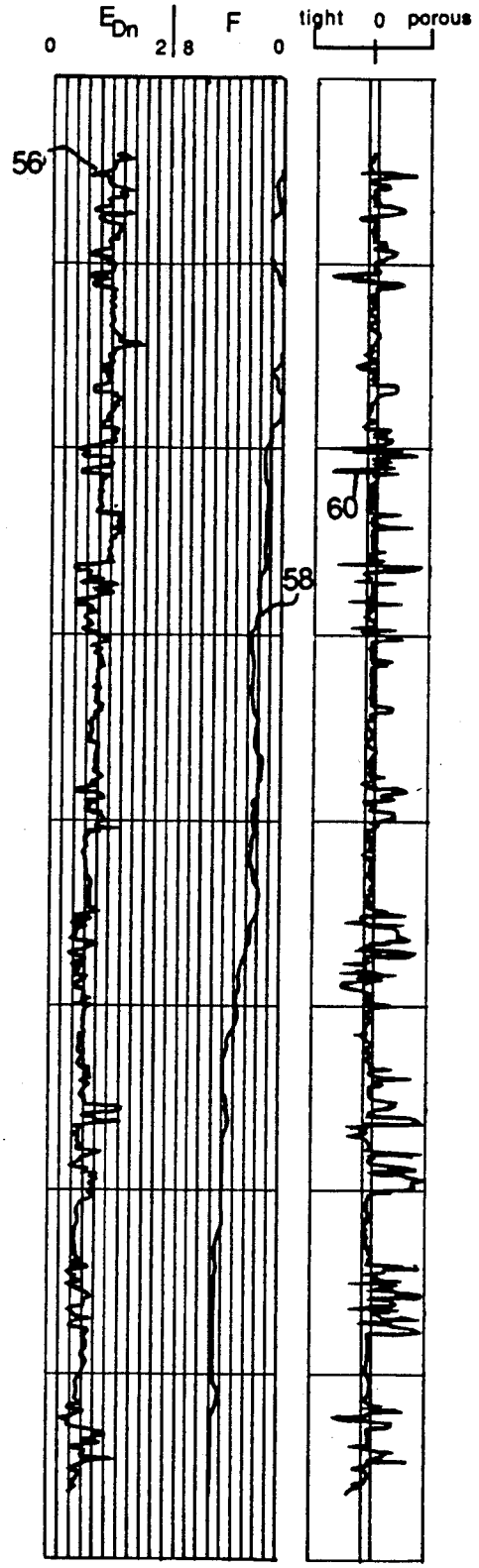

Turning now to FIG. 3, 4, and 5 there are illustrated example logs that have been generated in connection with an application of the principles of the present invention. These figures show the downhole measurement while drilling and surface derived data for a milled tooth bit run from a well drilling in the Gulf Coast region. An IADC series bit was used and the downhole instrument (MWD tool) was located above a single near bit stabilizer. The rotary speed over this bit run was maintained at approximately 140 rpm.

From left to right in FIG. 3 there appear Rate of Penetration (28) plotted on a plot from 0 to 200 feet per hour, downhole weight on bit (40) plotted from 0 to 50 klbs, downhole torque (42) plotted from 0 to 5 k ftlbs and MWD resistivity (48) plotted from 0 to 2.0 ohmmeters which serves to help distinguish sand/shale sections (Shale tends to have a higher resistivity than a water filled sand). In FIG. 4, also from left to right there appear dimensionless torque ($T_D$) (52) plotted on a scale of 0 to 1 and formation strength (FS) (54) on a scale of 0 to 200 kpsi. Through the shale sections $T_D$ shows a gradual decrease over the bit run which is attributed to tooth wear. In the sandstone sections $T_D$ becomes erratic and tends to mask the wear trend of the bit.

The formation strength curve clearly differentiates the sand/shale sections, the sandstones being the lower strength formations. Over the bit run the apparent strength of the shales increases from 20 to over 200 Kpsi, implying that the rock is harder to drill. However, this is more a function of the condition of the bit than the strength of the formation.

FIG. 5, left to right, there are shown logs of the following interpretation answer products apparent efficiency (56) (normalized dimensionless drilling efficiency $E_{Dn}$) plotted from 0 to 2, tooth wear ("Flat", F) (58) plotted from 0 to 8, and a formation properties curve (60) based on the drilling action of the bit. This last, formation properties curve, is merely the apparent efficiency divided by a running average of the apparent efficiency. The apparent efficiency curve shows gradual decrease over the shale sections which is attributed to the wear of the bit teeth.

By automatically applying shale limits around the efficiency curve, the drilling response in the shale sections can be discriminated and an accurate calculation of the wear of the bit teeth in the shale sections can be made (Flat). In the non shale sections the tooth wear is assumed constant. At the end of the bit run, the bit was graded at the surface to be worn to a value of 6 out of 8.

Changes from the normal drilling action of the bit in shale are indicated by sharp increases and decreases in the apparent efficiency. Based on the response of the efficiency curve and the change in formation strength, the formation is categorized by the formation properties curve as being either argillaceous (within the narrow central band), a porous sandstone type formation (falling to the right of the central narrow band), or a tight, low porosity type formation (falling to the left of the central narrow band). When compared to the resistivity log, an excellent correlation is evident between low resistivities and porous formations and between high resistivities and tight formations as indicated by the formation properties log. Since they are derived from the downhole torque measurement, both the formation properties and the formation strength logs have a distinct advantage over other MWD formation measurements in that they are derived at bit depth and are therefore indicative of the formation as it is drilled.

What is claimed is:

1. A method for monitoring the drilling process while drilling a borehole through subsurface formations with a drill bit, comprising the steps of:

a. generating a signal indicative of the torque applied to the drill bit in the drilling process; and b. distinguishing between argillaceous, porous and tight formations and generating an indication thereof in response to said signal indicative of torque.

2. The method as recited in claim 1 wherein said distinguishing step includes the steps of determining a reference value for said signal indicative of torque and performing a comparison between said signal indicative of torque and said reference value.

3. The method as recited in claim 2 wherein said distinguishing and signal generating steps include the steps of:

a. establishing high and low limits around said reference value, b. generating a signal indicative of porous formations when said comparison indicates said signal indicative of torque is greater than said high limit, c. generating a signal indicative of tight formations when said comparison indicates said signal indicative of torque is less than said low limit; and d. generating a signal indicative of argillaceous formations when said comparison indicates said signal indicative of torque is between said low limit and said high limit.

4. The method as recited in claim 2 wherein said reference value is determined from signals indicative of torque determined while said drill bit is drilling argillaceous formations.

5. The method as recited in claim 1 wherein said signal indicative of torque is indicative of dimensionless torque defined by the following relationship:

$$T_D = 12T/W*D$$

where T is the downhole torque experienced by the drill bit, W is the weight placed on the bit and D is the diameter of the bit.

6. The method as recited in claim 1 wherein said signal indicative of torque is a signal indicative of drilling efficiency corrected for friction and normalized for changes in weight on bit according to the following relationship:

$$E_{D_n} = [1-(1-E_D)(W)]/W_n$$

where ED is the drilling efficiency of the bit, W is the weight placed on the bit and $W_n$ is the weight that is recommended to be placed on the bit.

7. The method as recited in claim 1 wherein said signal indicative of torque is a signal indicative of drilling efficiency, said method further including the steps of:

a. generating an indication of the resistance to penetration of the formation by the drill bit;

b. in response to said indication of penetration resistance and to said indication of drilling efficiency, identifying porous formations and tight formations in addition to said argillaceous formations.

8. The method as recited in claim 1 further including the steps of:

a. generating an indication of the resistance to penetration of the formation by the drill bit;

b. in response to said indication of penetration resistance and to said indication of torque, identifying occurrences of abnormal torque.

9. The method as recited in claim 7, wherein said step of identifying porous and tight formations includes the steps of:

a. establishing a predetermined normal value of resistance to penetration of said formation by the drill bit;

b. comparing said indication of penetration resistance to said predetermined normal value of penetration resistance;

c. generating an indication of porous formation when said penetration resistance is smaller than said predetermined normal value; and d. generating an indication of tight formation when said penetration resistance is greater than said predetermined normal value.

10. The method as recited in claim 8, wherein said step of identifying occurrences of excess torque includes the steps of:

a. establishing a predetermined normal value of resistance to penetration of said formation by the drill bit;

b. establishing a predetermined normal value of said signal indicative of torque;

c. comparing said signal indicative of torque with said predetermined normal value of said signal indicative of torque;

d. comparing said indication of penetration resistance to said predetermined normal value of penetration resistance;

e. generating an indication of abnormal torque when said penetration resistance is greater than or equal to said predetermined normal value of penetration resistance and when said signal indicative of torque is larger than said predetermined normal value of said signal indicative of torque.

11. A method for monitoring the drilling process while drilling a borehole through subsurface formations with a drill bit, comprising the steps of:

a. deriving at least one signal which characterizes the unworn bit's drilling characteristics in argillaceous formations;

b. deriving at least one signal which characterizes the drilling of argillaceous formation as said subsurface formations are being drilled by said bit;

c. determining when the bit is penetrating formations that do not drill like argillaceous formation;

d. deriving a signal which characterizes the drilling of said formations that do not drill like argillaceous formations in response to one of said signals which characterize the drilling of argillaceous formations.

12. The method as recited in claim 11 wherein said signal which characterizes the drilling of said formations that do not drill like argillaceous formations is a signal indicative of the resistance to penetration of the formation.

13. The method as recited in claim 11 wherein said signal which characterizes the drilling of said formations that do not drill like argillaceous formations is a signal indicative of the drilling efficiency of the bit.

14. The method as recited in claim 11 wherein said step of determining when the bit is penetrating formations that do not drill like argillaceous formations includes the steps of:

a. generating a signal indicative of the torque applied to the drill bit in the drilling process; and
b. distinguishing between argillaceous and non-argillaceous formations and generating an indication thereof in response to said signal indicative or torque.

* * * * *